United States Patent [19]

Ziehm

[11] 4,231,567

[45] Nov. 4, 1980

[54] METHOD AND APPARATUS FOR CLEARING JAMS IN COPIERS

[75] Inventor: Richard T. Ziehm, Webster, N.Y.

[73] Assignee: Xerox Corporation, Stamford, Conn.

[21] Appl. No.: 965,666

[22] Filed: Dec. 1, 1978

[51] Int. Cl.[3] ..... B65H 7/06; B65H 43/04

[52] U.S. Cl. ..... 271/259; 340/674; 192/127

[58] Field of Search ..... 271/259, 258; 340/675, 340/674; 192/127

[56] References Cited

U.S. PATENT DOCUMENTS

| | | | |
|---|---|---|---|
| 3,603,585 | 9/1971 | Maloney et al. | 271/259 |
| 3,618,936 | 11/1971 | Ziehm | 271/259 X |
| 3,927,878 | 12/1975 | Bolsenga et al. | 271/259 X |

*Primary Examiner*—Bruce H. Stoner, Jr.

*Attorney, Agent, or Firm*—William A. Henry, II

[57] ABSTRACT

A method and apparatus for clearing jams in the transport path of a copier includes the steps of sensing a jam, clustering in-process sheets either at the jam location or at an area upstream of the jam location while simultaneously allowing sheets downstream from the jam location to continue out into a catch tray and removing the jam sheets after the last downstream sheet has exited the copier and the machine has stopped.

6 Claims, 3 Drawing Figures

METHOD AND APPARATUS FOR CLEARING JAMS IN COPIERS

SUMMARY AND BACKGROUND OF THE INVENTION

This invention relates to a document copying system, and more particularly, to a copier that has improved means of detecting and removing jammed sheets therefrom.

Modern day copiers employ ever increasing processing speeds and depending upon the size and complexity of the xerographic machine and its operating speed, a number of record sheets may be in the transport path which includes the sheet feeding apparatus for delivering the record sheets from the input stack or paper supply through the transfer fixing stages to the output station. Particularly when a number of copies are to be made of each document original and the new copies are to be stored and assembled or collated into orderly groups, it is necessary that no record sheets be lost in the copying operation and that the same number of copies be made of each document original. As is known, due to variations in record media, for example, the stacking and orientation of paper in the paper output tray and malfunctions in the paper feed or sheet feed apparatus, it is possible for jams to periodically occur in the operation of the copying apparatus.

In prior art machines when a jam occurred, the operator stopped the machine, removed the damaged sheets in the transport path collecting the good sheets. These good sheets were then sorted by hand. The copying process was then continued. Particularly where each reproduction of the set of originals must be accurate, it is undesirable to have the operator manually distribute the good copies in the transport path during a mulfunction. Further, where the reproduction apparatus is high speed, it is undesirable to have the operator hold up and delay high speed operation while performing a manual operation. Further, during the slow or manual operator sorting, errors may occur in which a record sheet is either not fused or improperly reproduced thereby resulting in a faulty copy in a particular group or reproduced set.

The present invention is intended to overcome the above-mentioned disadvantages and comprises copy sheet jam sensing means and copy sheet cluster means located along the transport path of the copier actuated in response to copy sheet jams. Upon sensing a jam occurrence at a jam area, in-process copy sheets are clustered at a cluster area upstream of the sensed jam area in response to a downstream jam by continuing the operation of at least part of said transport path to said cluster area. The copy sheets at the jam area and the copy sheets clustered at the cluster area are then removed.

PRIOR ART STATEMENT

Various prior art structures are known for detecting and remedying jam situations including U.S. Pat. No. 3,588,472, issued June 28, 1971 to Thomas H. Glaster et al which discloses a system wherein the number of recorded sheets entering a transport path of a reproducing apparatus are monitored along with the number of copies egressing from the transport path. These respective numbers are compared with the number of copies desired, and this comparison is utilized to provide a net count in a counter to indicate the number of originals from which the requisite number of copies have been made, completed, and delivered to a sorting area. Henry C. Price discloses in U.S. Pat. No. 3,819,266, issued June 25, 1974, a copying system incorporating means to stop the system in the event of a jam. A control is provided to inhibit restarting of the system except for recycling of the document handler until the malfunction is corrected. A method is disclosed in U.S. Pat. No. 3,944,794, issued Mar. 16, 1976, to Edward G. Reehil et al of programming a reproduction machine to compensate for copies lost or destroyed as a result of a paper jam during a copy run.

Included by reference herein is U.S. Pat. No. 4,078,787, issued Mar. 14, 1978 to Leroy E. Burlew which discloses a paper jam technique in a copier that causes a complete shutdown of the machine. Copier jam recovery is accomplished by opening machine access covers, removing the jammed sheets, and closing the covers.

An exemplary embodiment of the present invention is shown and described herein below as incorporated into an otherwise conventional exemplary xerographic apparatus and process. Accordingly, said xerographic apparatus and process itself need not be described in detail herein since various publications, patents and known apparatus are available to teach details thereof of those skilled in the art.

BRIEF DESCRIPTION OF THE DRAWINGS

Further objects, features and advantages of the present invention pertaining to the particular apparatus, steps and details whereby the above-mentioned aspects of the invention are attained will be included below. Accordingly, the invention will be better understood by reference to the following description and to the drawing forming a part thereof.

DESCRIPTION OF PREFERRED EMBODIMENT

Figure 1:
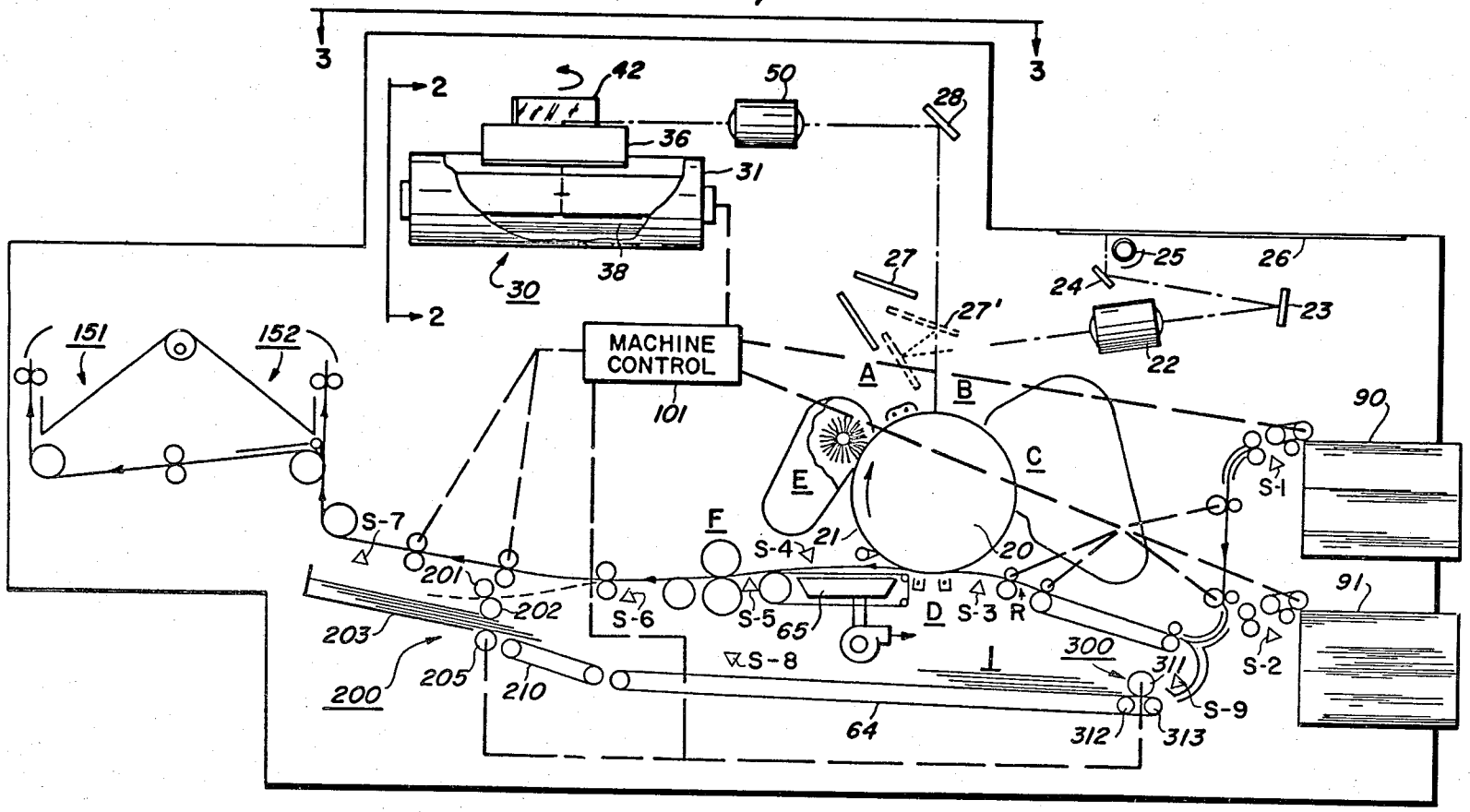
FIG. 1 is a side view of a bidirectional xerographic copying system with collated copy sheet output that employs the present invention.

Referring to FIG. 1, there is shown a schematic illustration of a exemplary reproduction machine 10 that employs a set sensors S1 through S9 that will accomplish the objectives of the present invention. It includes a conventional photoconductive layer or light sensitive surface 21 on a conductive backing and formed in the shape of a drum which is mounted on a shaft journaled in a frame to rotate in the direction indicated by the arrow to cause the drum surface to pass sequentially a plurality of xerographic process stations. It should be understood that belt photoreceptor and flash exposure could be used instead of the photoreceptor and exposure means shown in FIG. 1.

For purposes of the present disclosure, the several generally conventional xerographic processing stations in the path of movement of the drum surface may be described functionally as follows:

a charging station A at which the photoconductive layer of the xerographic drum is uniformly charged;

an exposure station B at which a light or radiation pattern of a document could be reproduced is projected onto the drum surface to dissipate the drum charges in the exposed areas thereof, thereby forming the latent electrostatic image of a copy to be reproduced;

a developing station C where xerographic developers are applied to the photoconductive surface of the drum to render the latent image visible;

a transfer station D at which the xerographic developer image is electrostatically transferred from the drum surface to a transfer support material;

a drum cleaning station E at which the drum surface is brushed to remove residual toner particles remaining thereon after image transfer; and a fusing station F at which point the image is fused to the copy paper or support material.

For copying, the xerographic apparatus 10 disclosed herein projects an image from the automatic web scroll document handling apparatus 30 described in U.S. Pat. No. 3,963,345, issued to D. Stemmle and M. Silverberg, which disclosure is incorporated herein by reference.

The document images are projected through lens 50 down from mirror 28 of FIG. 1 onto the photoreceptor 20. The image is developed on the photoreceptor surface 21 and rotated clockwise to a transfer station D. Copy sheets coming from either the main copy sheet feeding tray 90 or the auxiliary sheet feeding tray 91 are fed by a series of sheet feeding rollers to the transfer station D in order to accept the developed image from the photoreceptor drum 20 at the transfer station D. Vacuum stripping means 65 strips the paper from the photoreceptor 20 and transports it toward fuser F so that the image can be fused onto the copy sheet. Thereafter, the copy sheet is transported either to duplex tray 200 or to an output sheet tray 151 or 152. For simplex copies, the duplex tray 200 is not utilized. Documents can be imaged in the apparatus of FIG. 1 either from the automatic document handler or from platen 26.

For uni-directional document copying, all of the sets will be in one output tray. The same output tray 151 is used whether the copies are simplex or duplex. Collation occurs without an inverter. For bi-directional copying, alternate sets are ultimately placed in trays 151 and 152. The forward order copies go into tray 151, and the reverse order copies go into tray 152.

Figure 2:
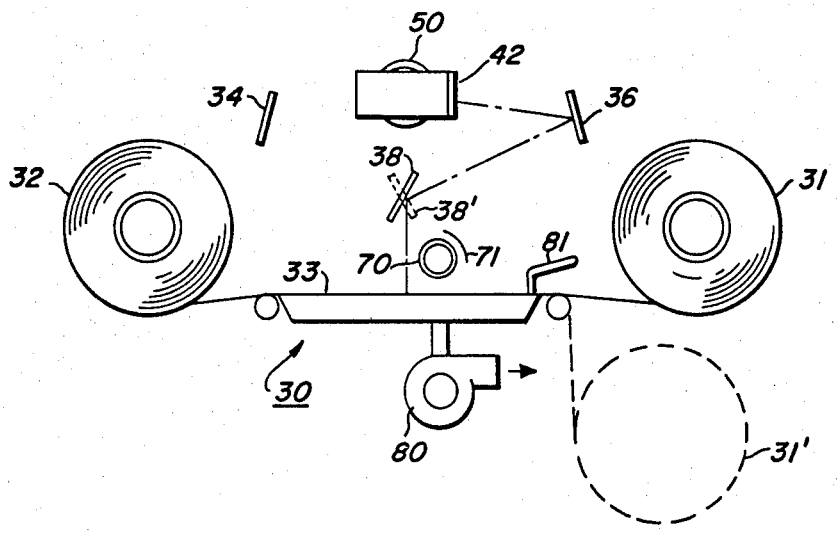
FIG. 2 is a side view taken along line 2—2 of the automatic document handling apparatus shown partly cut away in FIG. 1.

As shown in FIG. 2, documents are loaded by being placed onto web 33 against registration means 81 while scroll 31' is in the load/unload position. As the documents are moved by the automatic document handler (hereinafter called ADH), they are exposed to light directly from exposure lamp means 70 and reflected through reflector means 71 off the document into a bi-directional optical system for projection of the document image onto photoreceptor 20. Each sheet is conveyed past exposure means 70 and reflector means 71 and wound onto scroll means 32 after scroll means 31 has been moved into recirculation position. Subsequently, scroll means 32 is reversed in direction toward scroll means 31 to allow re-exposure of the documents in a reverse scan mode.

For the first exposure of the documents on page images on the web, only even numbered documents are imaged, i.e. documents located in the 2, 4, 6, 8, etc. positions on web 33. Depending on whether uni-directional or bi-directional copying is desired, the buffer set is a one-set or two-set buffer, respectively. For uni-directional copying, a fast reverse rewind is accomplished and only one buffer set is required. For bi-directional copying, the even numbered documents are also imaged during reverse movement of the web to create two-buffer sets, one in ascending order (2, 4, 6 . . . ) and one in descending order (8, 6, 4, 2). In either case, copies made from exposure of the even numbered documents are fused at station F and continued in transportation on a conventional conveyor system into buffer tray means 200.

Documents in the document handler are imaged, even numbered documents first on a forward pass of the document handler (hereinafter referred to as ADH) with the images obtained from the documents being transferred to copy sheets fed from copy sheet tray 90. After the images have been transferred at station D, the one-side imaged sheets are then forwarded toward buffer set means 200. In route to the buffer set means 200, the copy sheets are first forwarded by receiving means 201 and 202 into stacking means 203. After the first sheet has been deposited into duplex buffer means 200, as each additional sheet is forwarded into stacking means 203, the latter sheets are indexed a predetermined amount by shingling means 205 so as to separate each additional incoming sheet into the buffer means a predetermined amount for subsequent refeeding to transfer station D in order to have second side images placed thereon.

Shingling means 205 causes a set of one-sided copy sheets to be presented to conveyor transport means 210 in an offset, stair-stepped fashion such that the offset is about ½ inch. After a complete set of one-sided copies has been shingled by shingle means 205, conveyor transport means 210 moves the completed set at a high rate of speed onto a second conveyor means 64 which is adaptable to also move the completed set at a high rate of speed to refeeding means 300 for subsequent refeeding of the sheets for secondside copying. Refeeding means 300 includes a feeding roller 311 and separating rollers 312 and 313 that work in conjunction to forward the sheets back to transfer station D in order to receive images on the second side of the copy sheets.

Figure 3:
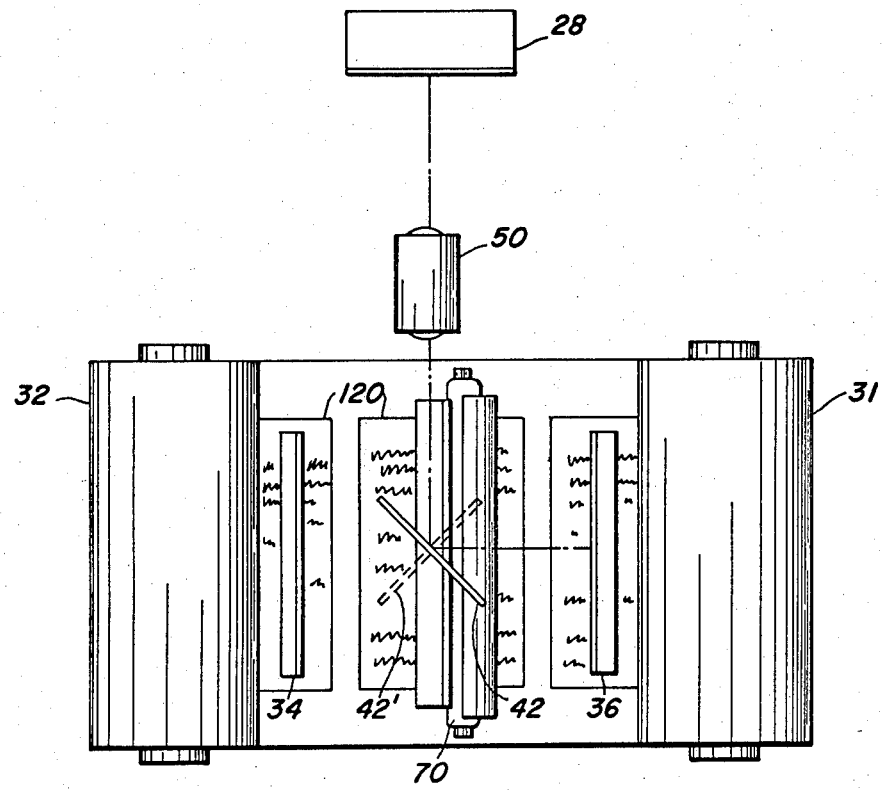
FIG. 3 is a top view taken along line 3—3 of FIG. 1.

Shingling means 205, as well as forwarding means 210 and transport means 64, are controlled by machine control means 101 with the transport means 64 and forwarding means 210 being actuated in response to the completion of a set of one-side copy sheets entering duplex tray means 200 to fast forward the set to refeeding means 300. It should be understood that more than one set of one-sided copies could be placed on transport means 64 at the same time if one desired. On succeeding passes on the automatic document handler, forward and reverse, all documents are imaged with copy substrates being fed from the copy sheet tray 90 to transfer station D alternately with copy sheets fed from refeeding means 300. Copy sheets fed from primary copy sheet tray 90 receive images of even positioned documents in the ADH and are fed to buffer tray means 200 while copy sheets that are fed from refeeding means 300 alternate with the sheets fed from the primary copy sheet tray and received images on the reverse side thereof of odd positioned documents in the ADH and are fed to output station 151 for copy sets made on the forward pass, or station 152 for copy sets made on the reverse pass, so that once a completed, collated set of documents have been collected in the output station, they may be stapled and side stacked or staggered and they will still read in consecutive ascending order, for instance, 1, 2, 3, 4, 5, 6 etc. On the last pass of web 33 past the exposure station 70, only odd numbered or positioned documents 120 are imaged as shown in FIG. 3. The images are then copied on the back of copies previously made from even numbered documents that are fed by refeeding means 300. This process empties the refeeding means and presents the final set of duplexed copies to the output station. However, if a two-set buffer is used, i.e., if the ADH imaged documents on both the forward and reverse scans, odd numbered documents (only) are imaged on both of the final forward and reverse scans of web 33 in order to make complete duplexed copies of the two sets of evens located adjacent to each other on transport means 64 adapted for refeeding by means 300 in order to finish the duplex run of collated sets with an empty transport means 64 and refeeding means 300.

In reference to FIG. 2, an optical system for scanning documents in both directions of relative reciprocal motion between the documents and the optical system is shown. The document is first scanned in one direction, then the image orientation is rotated 180° about the axis of propagation for scanning in the reverse direction. Properly oriented images are thus projected onto photoreceptor 20 and move in the same direction during both directions of scan, i.e. moving in the same direction as the photoreceptor surface in both cases without reversing the photoreceptor movement. This is more fully disclosed in U.S. Pat. No. 4,008,958.

A programmable machine controller 101 is used to control the operation of xerographic reproduction in either the simplex or duplex modes of copier 10, such as, the controller disclosed in allowed U.S. application Ser. No. 829,014, filed Aug. 30, 1977, in the name of James M. Donahue et al now U.S. Pat. No. 4,144,550, or U.S. Pat. No. 3,940,210, both of which are incorporated herein by reference.

Incorporated into the above described copier is a jam detection and clearing system according to the present invention wherein a substrate jam occurring in non-critical areas of the xerographic process would not cause a "hard-stop" of the copier. Rather all good copies downstream of the jam area would be continued on through the processor until they have exited the machine, and then the processor would be stopped. All of the copy sheets upstream of the jam area would be accumulated or clustered at one area. The feeding of new copy sheets could be stopped when the jam occurs so that only the sheets already in process would be clustered. That is, there is a cycle-out run during which the good copies are run out while the copies behind the jam zone are deliberately driven into the (sensed) jam zone, or into the nearest desired cluster point upstream of the jam zone. By clustering of all of the copy sheets in one machine point during a jam condition for single point removal, the operator time and activity conventionally required to remove all the copy sheets from different parts of the process when a jam occurs is minimized and simplified. Job recovery, i.e., accounting for lost copy sheets, is simplified also.

One good location for cluster jamming is, for example, the registration rollers R, since the jam sensed anywhere upstream thereof can be used to stop the registration rollers and cause the sheets to cluster there. The microcontroller 101 will always note where the various copy sheets are during the process operation, and when the jam has occurred, it will actuate the cluster jamming by deactuating paper path rollers at the appropriate point for either single point removal of jammed sheets or two point clearing of the jam, i.e. by clustering in-process sheets upstream of the jam in a location other than at the jam location. However, certain paper jams, such as fuser exit jams or photoreceptor mis-strips will preferably remain "hard-stopped" control singal jams to avoid situations where, for example, wrap-around of the copy sheet could potentially cause damage to other machine components.

More particularly, in FIG. 1, jam sensors S1 through S9 are shown for sensing substrate location during a copying operation, however, any number of sensors could be used to give the degree of control of substrates desired. Any conventional sensor could be used, for example, the sensors disclosed in allowed U.S. application Ser. No. 829,014, filed Aug. 30, 1977 and incorporated herein by reference. As a substrate passes from either paper feeder 90 and 91 in route throughout the paper path of machine 10, sensors S1–S9 are actuated by controller 101 to sense the presence of a sheet or substrate according to a timing sequence. If a sheet is not sensed as having passed a particular sensor, a signal is transmitted to the controller which is connected to various transport rollers for disengaging a set of rollers at an appropriate location in order to create clustering. Upon receiving a signal indicating the absence of a sheet controller 101 will either switch the machine to a "hard-stop," i.e., stop the machine completely, or switch the machine into its "soft-stop" mode which allows for sheets already in process downstream of the sensed jam area to continue out into the output stacker 151 or 152. Sensors S4 and S6 are used to "hard-stop" the machine due to mis-strip of sheets from the photoreceptor 20 and failure of sheets to exit the fuser F, respectively. After the jam area has been cleared during a "hard-stop," the machine is adapted to be actuated without clearing the paper path entirely with all sheets remaining in the paper path exiting into output tray 151 or 152. These sheets are discarded and a new run commenced.

In conclusion, a method and apparatus is disclosed for detecting and clearing jams wherein sheets in process through a paper path are monitored by sensors that transmit signals to a central processing unit (cpu). Once a jam is sensed, paper feeders 90 or 91 are stopped while the cpu, according to programmed instructions, controls feed rollers along the paper transport path so as to cluster any sheets upstream of the jam either at the jam location or at a separate point upstream of the jam location while sheets downstream of the jam continue processing out to the output tray.

In addition to the method and apparatus disclosed above, other modifications and/or additions will readily appear to those skilled in the art upon reading this disclosure and are intended to be encompassed within the invention disclosed and claimed herein.

What is claimed is:

1. In a copier having means for making copies of document images including a copy input and a copy output and an in-process copy sheet normal transport path therebetween, the improved method for clearing copy sheet jams within the transport path comprising the steps of:

(a) providing copy sheet jam sensing and copy sheet cluster areas within said normal transport path actuable in response to copy sheet jams, (b) sensing a jam occurrence at a jam area, (c) clustering in-process copy sheets at a cluster area within said normal transport path upstream of a jam sensing area in response to a downstream jam by continuing the operation of at least part of said transport path to said cluster area; and (d) removing the copy sheets at the jam area and the copy sheets clustered at said cluster area.

2. The method of claim 1, including the further step of:

transporting out to said copy output all copy sheets downstream of the sensed jam area.

3. The method of claims 1 or 2, wherein feeding of copies from said copy input is inhibited once a jam is sensed.

4. A method for clearing jams in a copier with a normal transport path for in-process copy sheets comprising the steps of:

(a) sensing a jam occurrence at a jam occurrence location within said normal transport path; and (b) clustering in-process copy sheets at said jam occurrence location, for one-point removal, by preventing the transport of any copy sheets beyond said jam occurrence location which are upstream of said jam occurrence location when said jam occurs and by transporting said copy sheets which are within said normal transport path and upstream of said jam occurrence location when said jam occurs into said jam occurrence location.

5. The method of claim 4 including the additional step of transporting out to said copy output all copy sheets downstream of said sensed jam occurrence location, and then stopping the copier.

6. The method of claim 1 wherein said clustering includes the step of superimposing sheets at a feed roll nip, said feed roll nip being a normal individual sheet transport means.

* * * * *